US008490257B2

(12) United States Patent
Cameron

(10) Patent No.: US 8,490,257 B2
(45) Date of Patent: Jul. 23, 2013

(54) INTEGRATED LOGO FASTENING SYSTEM

(76) Inventor: Paige Cameron, Los Angeles, CA (US)

( * ) Notice: Subject to any disclaimer, the term of this patent is extended or adjusted under 35 U.S.C. 154(b) by 522 days.

(21) Appl. No.: 12/726,834

(22) Filed: Mar. 18, 2010

(65) Prior Publication Data

US 2011/0225781 A1 Sep. 22, 2011

(51) Int. Cl.
*A44B 17/00* (2006.01)
*D06F 95/00* (2006.01)

(52) U.S. Cl.
USPC ..... 24/674; 24/104; 24/108; 24/114.9; 24/DIG. 29

(58) Field of Classification Search
USPC ..... 24/3.1, 3.12, 459, 90.1, DIG. 29, 24/104, 108, 114.9, 674; 2/239; 36/1
See application file for complete search history.

(56) References Cited

U.S. PATENT DOCUMENTS 2,199,148 A * 4/1940 Farnham ..... 24/110
2,548,004 A * 4/1951 Duefrene ..... 24/662
2,658,249 A * 11/1953 Wilson ..... 24/102 SL
3,041,743 A * 7/1962 Monsma ..... 36/1
4,272,869 A * 6/1981 Willner ..... 24/3.12
4,296,533 A * 10/1981 Doerter ..... 24/581.1
4,850,502 A * 7/1989 Davis ..... 220/759
5,038,413 A * 8/1991 Ursino ..... 2/239
5,136,758 A * 8/1992 Wilcox et al. ..... 24/431
5,490,309 A * 2/1996 Velasquez et al. ..... 24/90.1
5,699,557 A * 12/1997 Johnson ..... 2/239
6,032,294 A * 3/2000 Dean ..... 2/239
6,058,577 A * 5/2000 Ida et al. ..... 24/306
6,092,241 A * 7/2000 Bellet ..... 2/239
6,216,279 B1 * 4/2001 Ellingson ..... 2/239
6,647,555 B2 * 11/2003 Yamaguchi et al. ..... 2/338
7,058,986 B2 * 6/2006 Pietzyk-Hardy ..... 2/239
2005/0262615 A1 * 12/2005 Pietzyk-Hardy ..... 2/239
2007/0256280 A1 * 11/2007 Azan ..... 24/90.1

* cited by examiner

*Primary Examiner* — Robert J Sandy
*Assistant Examiner* — Louis Mercado
(74) *Attorney, Agent, or Firm* — Tucker Ellis LLP

(57) ABSTRACT

A functionally decorative fastening system includes first and second fastener portions, each fixable to an article, so as to selectively allow for the articles to be secured together purposes such as transit, storage or laundering. Complementary mating surfaces of each fastener portion include decorative features, such as artwork, logos, trademarks, or the like. The decorative mating surfaces serve functionally to selectively lock the two fastener portions together when aligned and pushed together. Such integrated fastening is accomplished via mechanical interaction between the decorative mating surfaces.

4 Claims, 3 Drawing Sheets

INTEGRATED LOGO FASTENING SYSTEM

BACKGROUND OF THE INVENTION

This application is directed broadly to merging branding and brand awareness with functionality and utility. The application is particularly advantageous in connection with the transport, storage or laundering of matched attire pieces, such as socks or gloves, in pairs or with additional items, such as hats or scarves.

Historically, consumer purchasing decisions were based almost solely on need, utility and cost. More recently, advances in technology and increasing competition among suppliers, coupled with increasing disposable income available to consumers, has altered the marketplace. Manufactures invest significantly in establishing recognition of their brands. A manufacturer's trademark, affixed to goods or packaging, allowed a consumer to quickly recognize a product's source of origin, and associate a known quality standard to a product.

Today, trademarks have evolved further from the role of merely indicating a source of origin. The marks have themselves acquired significance, and form a significant role in a design or appearance of a product. This is particularly true in connection with attire, including a diverse array of products including hats, shoes, shirts, pants, socks, purses and sweat bands. Fanciful trademarks appear prominently on products, functioning as a statement made by the wearer and as a status indicator. Consumers, particularly male consumers, may pay a substantial premium for attire bearing logos by brands such as NIKE or ADDIDAS. Consumers, particularly female consumers, may pay a substantial premium for purses bearing brands such as COACH or PRADA.

Manufactures now invest heavily in securing brand recognition. Professional athletes often derive more income from displaying branded clothing than they earn from the sport, itself. Prominent display of a NIKE swoosh on a cap of a professional golfer will secure much personal and media exposure to the brand as it is displayed prominently during competition. In addition to brand awareness, consumers may be drawn to seek out and purchase for themselves the product being viewed.

In view of the forgoing, there is a significant focus placed on integration of branding on articles, particularly articles of clothing. However, such integration is visual only, adding no function or value to the article.

SUMMARY OF THE INVENTION

The subject application teaches a system which integrates branding into articles, particularly articles of clothing, in a fashion that is both visually appealing and functional to the consumer.

DETAILED DESCRIPTION

There are many fasteners commonly used in connection with the manufacture of wearable articles. Such fasteners include buttons, zippers, snaps, hook and loop (commonly sold under the Velcro brand) and ties. Other than buttons and snap surfaces, which occasionally employ decorative knobs, fasteners are generally not considered for visual characteristics. Fasteners are virtually never visually integrated into clothing design.

Figure 1:
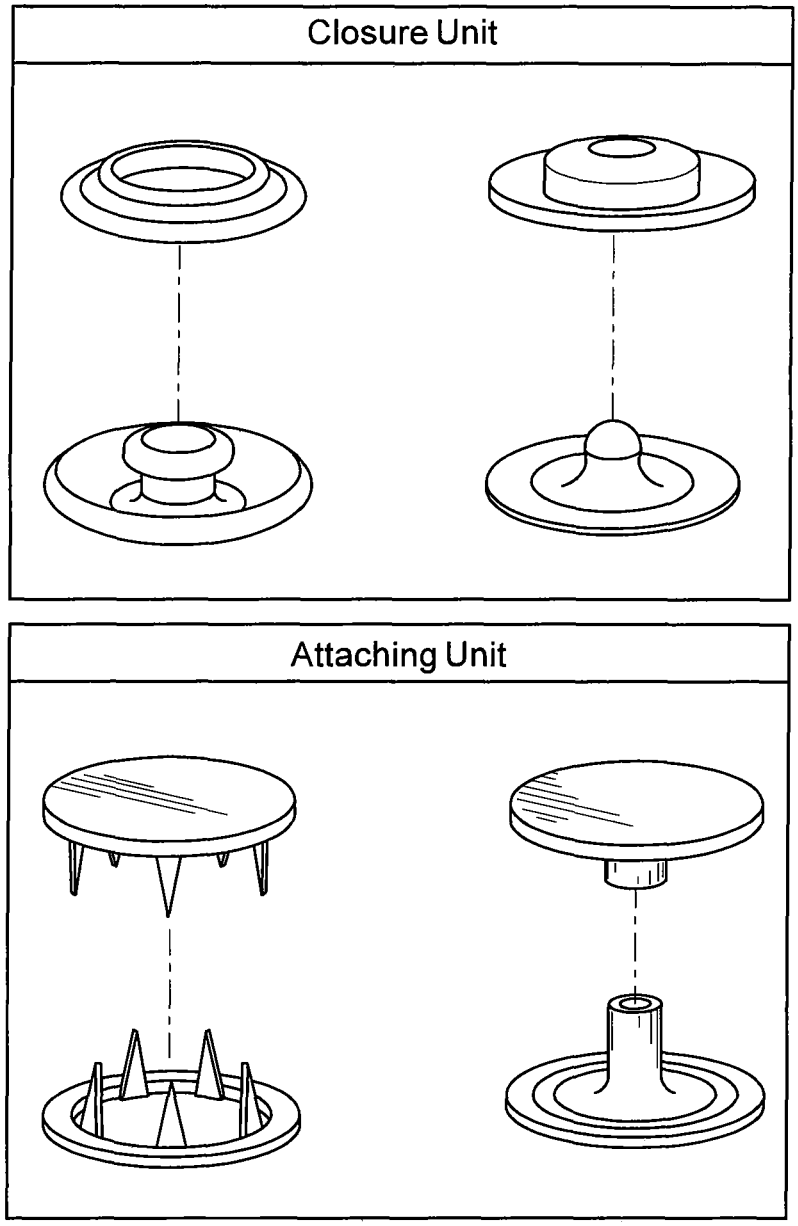
Fig. 1 (Prior Art)
FIG. 1 illustrates a prior art snap fastener.

Snap fasters, also referred to as snaps, poppers or press studs, have been in use for over 100 years. Snap fasteners were first patented in 1885 by German inventor Heribert Bauer as a novelty fastener for men's trousers. Components of a snap fastener typically include interlocking discs. In one embodiment, a circular lip under one disk fits into a groove on a top surface of a complementary disk. Pressure between the disks results in closure to secure both portions until sufficient force is applied to separate them. In the 1940s, four-part snaps became popular. In the four part snap, a closure unit mates with an attaching unit. Referring to FIG. 1, the closure unit is comprised of a socket and a projection-bearing stud. The stud is positioned on an opposite side of fabric from the socket. Applied force between the two secures the closure unit to the fabric. The attaching unit is comprised of either a capped prong ring and an open prong ring, or a capped post and a complementary post. As with the closure unit, complementary components are secured to one another on opposite sides of the fabric. Pressure applied between the closure unit and the attaching unit results in closure of the fastener. A representative snap closure design is found in FIG. 1.

Advances in materials have lead to metals, plastics and ceramics that can be formed in many different thicknesses, sizes and shapes. By way of example, suitable fabrication techniques for snaps suitably include stamping, injection molding and blow molding. Advances in materials and in manufacturing technology allow for forming of metal, plastics and ceramics into many shapes and sizes than have been available in the past. Given these advances, complementary, mating snap portions are suitably manufactured in varying styles and sizes. Integration of logos into a snap facilitates a blending of both functionality and visible branding so important for securing market share.

While a fastener, visually and functionally integrated with a logo, is usable with any wearable article, it is particularly advantageous in an embodiment wherein separate, complementary articles are involved. Articles, such as gloves, mittens or socks are generally purchased in pairs. When being transported, laundered or stored, these items are frequently separated. A loss of one item renders the other item largely useless. Thus, time is frequently wasted searching for a mating item. Other attempts have been made to join items together when not being worn. Earlier solutions have included a separate clipping device. This is advantageous insofar as it does not visually detract from the articles when used to join them together since it is removed before the articles are worn. However, since the fastener is separate, it must be stored when not in use, and most be retrieved each time articles are to be secured to one another. Still other attempts have incorporated fastening structure on the articles themselves. However, such devices suffer from diminished aesthetics due to the visible fastener presence. This is particularly true with articles, such as socks. Socks, particularly athletic socks, are often fully visible other than that portion covered by a shoe. Since a fastener, such as a clothing snap, is rigid in design, it must be secured above the shoe line to avoid discomfort. Such placement renders the snap visible.

The subject teaching of integrating a logo design into mating fastener portions allows for in improved solution to all earlier attempts. It advantageously allows for the functional characteristics of a snap to be integrated with a visible logo.

Since there is no need to disguise the presence of the fastener, it is advantageously placed in an optimal fastening location, such as at a midpoint of the stocking riser, and at an outside position relative to the wearer.

Snaps having an integrated logo are advantageously used on socks, as well as any other garments that are attached to one another by an attachment device. Each is suitably designed in the shape, color, style and proprietary design of trademarks and logos owned by various known corporations and organizations including but not limited to sports teams, corporate logos, animated characters, footballs, baseballs, basketballs, tennis balls, any and all other sports apparatus, including all possible designs able to be constructed into the apparatus or mounted upon or around the closure apparatus. The functional nature of the snap and integrated logo further serves to draw additional attention to the logo, thus providing further value and brand recognition.

The inclusion of logo and trademark in the snap closures is suitably applied to clothing of all kinds such as socks, gloves, shirts and pants (such as with pre-selected matching sets). This functions to create brand application to the integrated logo snapping mechanism. Integration with articles of clothing allow for ready storage and retrieval of matching sets, thus enabling a child to retrieve coordinated clothing for self dressing, as well as to assist in matching and attaching two garments for storage and ease of use next time.

By way of further example, with socks, a use of football helmet logos provides a means for professional, college, school and little league teams to sell socks with their brand or logo and the consumer can link the pair together when removed so that they are not lost in the laundry and are paired for use after they are cleaned.

The integrated logo fastening system allows a consumer to keep the correct items, such socks together. Often many white socks or colored socks look similar in design and shape. The integrated logo snapping mechanism allow for advertisement on any garment and provides a method of recognition of which garments pair together and facilitates their storage and care by keeping them together.

The application of proprietary design logos, trademarks, brands etc. is particularly advantageous, as noted above. The integrated logo snapping mechanism provides a place to use such designs for licensing purposes that also has a functional purpose for the garment and will allow the design to be organically integrated into a garment that will have novel and convenient applications for the consumer.

Functional pairing of garment provides an incentive to buy the garment as does the integrated design. By way of further example, if a consumer, who is a Dallas Cowboys fan, may need a new pair of athletic socks. They are likely to choose to buy a pair of socks with the integrated logo snapping mechanism on them with snaps in the shape of the Dallas Cowboys' helmets. The consumer will tend to purchase an item that solves their problem of losing one of the pair while allowing them to wear a garment that promotes their team.

It will be appreciate that many more applications are possible, and are envisioned herein. These include such applications as promotion of promote charity events, causes such as the pink ribbon for breast cancer awareness, the red ribbon for AIDS research or the yellow ribbon to bring our troops home.

The integrated logo snapping mechanism can be used to attach anything to anything, not just garments. For example, it is suitably implement to attach a water bottle to a backpack using an integrated logo snapping mechanism in the shape of a NIKE SWOOSH. If the backpack and bottle are made by NIKE, it again fulfills a function of providing two products that go together and should stay together while also identifying and advertising the NIKE brand.

The structure of the integrated logo snapping mechanism would be a male and female component engineered to function with each design or brand. It could include the entire shape of the logo as perhaps in the case of a TARGET bulls eye or it could incorporate just part of the logo in the functional design as in the shape of a football helmet where the small detail of the tooth cage is not part of the functional pairing closure device but is integrated into it to provide both the dual advertising as well as functional purposes.

Figure 2:
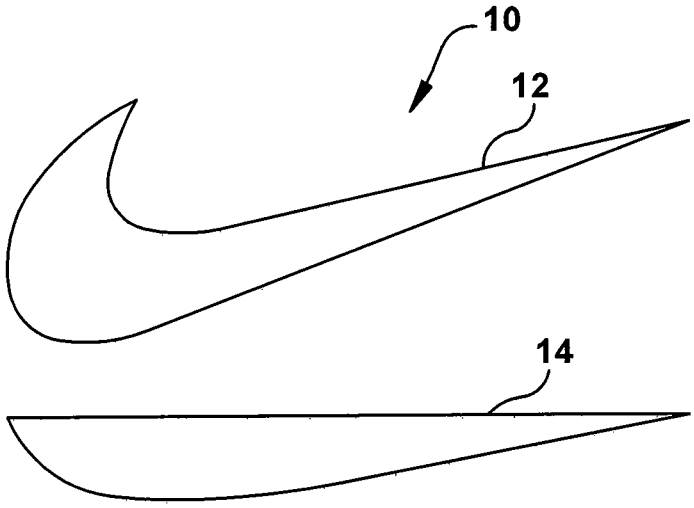
FIG. 2 illustrates a representative three-dimensional decorative formation in the form of a trademark.

FIG. 2 and present an illustrative embodiment of a suitable fastener as described above. The figures use the NIKE SWOOSH, noted above, which design is a registered trademark of Nike, Inc., and is used herein for illustrative purposes only. FIG. 2 sets forth complementary logo portions 10 and 20, as illustrated by complementary side views 14 and 24. In the illustrated embodiment, portion 10 is generally concave while portion 20 is generally convex. In a preferred embodiment, portions 10 and 20 are affixed respectively to two articles, such as each being affixed to one of a mating pair of socks. When generally convex portion 20 is received into generally concave portion 10 when the two socks are to be joined, such as while being stored, transported or laundered. A suitably connection mechanism, such as a snap ring illustrated generally at 12, along with complementary portion 22, causes the mating portions to adhere to one another until separated by sufficient force. Such force considerations are subject to individual design or application criteria, and are suitably such that separation forces exceed that anticipated by storage, transportation or laundering.

Figure 4:
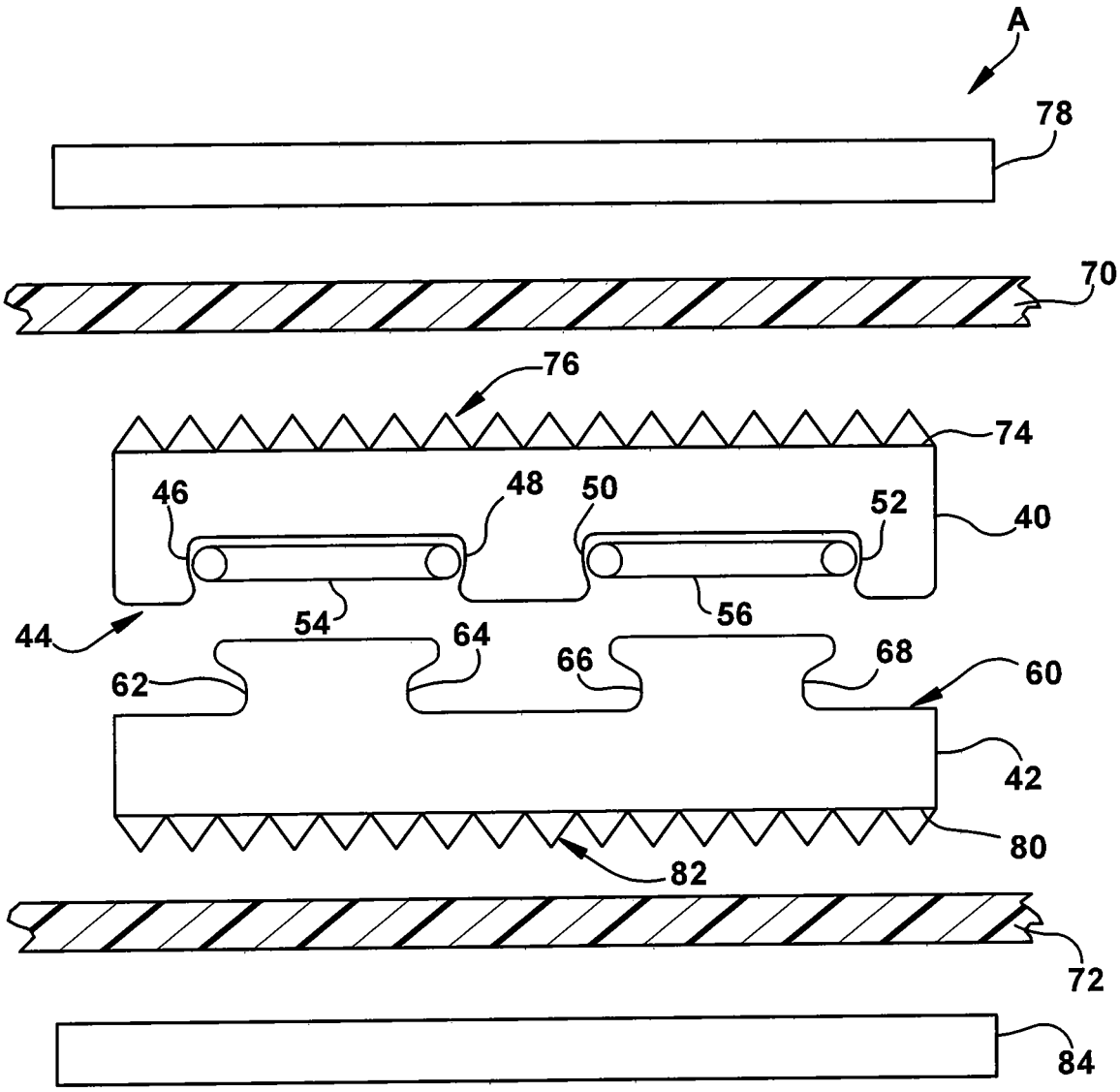
FIG. 4 is a cut away side view of a multi-part decorative fastening system.

Turning now to FIG. 4, illustrated is a cut away, side view of a decorative fastening system A having a first clasp portion 40 and a second clasp portion 42. The first clasp portion 40 has a first surface portion 44 which defines a three-dimensional decorative image. Contours 46, 48, 50 and 52 suitably contain springs 54 and 56. The springs are suitably shaped as a ring, or other two-dimensional contour such as a U-shape, V-shape, serpentine shape, or any other suitable orientation that allows for the spring to be retained in a corresponding contour. A mating surface 60 of the second clasp portion 42 suitably includes contours 62, 64, 66 and 68, corresponding respectively to contours 46, 48, 50 and 52 in the illustrated embodiment. Sizing of the contours 46, 48, 50 and 52 is selected to complement those of the opposing contours. It will be appreciated that a decorative image on surface portion 44 is suitably a visual negative of the image on surface portion 40. Given the relative sizing and positioning, urging of first clasp portion 40 toward second clasp portion 42 with appropriate, relative orientation, will result in a meshing of the complementary decorative images, and engaging of the springs 54 and 56 in the corresponding contours of mating surface 60, resulting in fastening of the two portions. Conversely, application of opposed force will result in a retraction of the springs around contours of surface 60, and separation of the first and second clasps.

While two spring portions are in the illustration, it will be appreciated that one or more springs are suitably implement, depending on particulars of each selected decorative image.

Also illustrated in FIG. 4 is a first and second articles 70 and 72, suitably comprised of fabric, plastic, leather or other sheet or web material, or any suitable surface adaptable to secure a clasp portion thereto. A second surface 74 of the first clasp portion 40, suitably disposed opposite the decorative surface 44, suitably engages the article 70 with a fastener, such as a serrated edge 76, via an adhesive, or via a secondary fastener such as is illustrated at 78 which engages surface 74 via passage through article 70. Analogous constitution is associated with second clasp portion 42 via surface 80, serrated edge 82, article 72 and secondary fastener 84. However, it will be appreciated that both first clasp portion 40 and second clasp portion 42 suitably employ relatively unique fixation to their respective articles.

Figure 3:
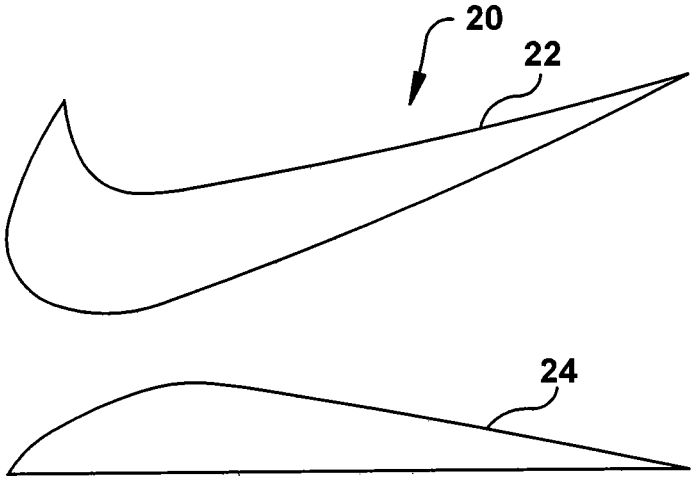
FIG. 3 illustrates another three-dimensional decorative formation in the form of a trademark.

While FIGS. 2 through 4 are illustrative of a mating snap design, it will be appreciated that other, alternative mating designs are suitably used. By way of further example, a contour for another logo type may be amenable to a design wherein both portions each have multiple convex or concave portions adapted for mating engagement there between. Additionally, fastening is suitably accomplishes with complementary magnetized portions wherein attractive force for adjoining portions is sufficiently strong for a desired application. Still other logo designs suitably implement other fastening systems, such as tongue-in-groove or other slotted systems. While snap systems are advantageous for many applications, it will be appreciated that various alternatives are advantageously used in accordance with various logo designs in order to maintain aesthetic appeal, integrity of a logo and sufficient fastening or release characteristics.

It is claimed:

1. A functionally decorative fastening system comprising:

a first clasp portion including, a first surface portion having integrated thereon a three-dimensional decorative image comprised of a trademark extending outwardly therefrom, and a first clasp mounting portion operatively associated with a second surface disposed opposite the first surface, the first mounting portion adapted to be secured to an associated article; and a second clasp portion including, a mating surface having integrated thereon a complementary three-dimensional image to the three-dimensional decorative image and adapted to be selectively securable to the first surface portion by a mechanical interaction between an outer edge of the three-dimensional decorative image and an inner edge of the complementary three-dimensional decorative image of the first clasp disposed in a nesting relationship therebetween, and a second clasp mounting portion operatively associated with a second surface disposed opposite the mating surface, the second mounting portion adapted to be secured to a complementary associated article.

2. The fastening system of claim 1 wherein the associated article and the complementary associated article are comprised of first and second hand coverings.

3. The fastening system of claim 1 wherein the associated article and the complementary associated article are comprised of first and second socks.

4. The fastening system of claim 1 wherein the associated article and the complementary associated article are comprised of first and second shoes.

* * * * *